United States Patent [19]

Reiter et al.

[11] Patent Number: 4,603,542

[45] Date of Patent: Aug. 5, 1986

[54] BOOKLET CRISS-CROSS STACKING FIXTURE

[75] Inventors: Eli Reiter, Dix Hills; Joseph R. Robson, Smithtown, both of N.Y.

[73] Assignee: General Aero Products Corp., Copiague, N.Y.

[21] Appl. No.: 668,204

[22] Filed: Nov. 5, 1984

[51] Int. Cl.[4] ..... B65B 27/08; B65H 33/08

[52] U.S. Cl. ..... 53/585; 53/390; 53/592; 100/9; 206/449; 206/451; 206/805; 414/54; 414/97

[58] Field of Search ..... 414/54, 97; 53/390, 53/592, 585; 100/9, 34; 206/449, 451, 805; 211/50

[56] References Cited

U.S. PATENT DOCUMENTS

| | | | |
|---|---|---|---|
| 1,096,356 | 5/1914 | Downey | 211/50 |
| 2,485,419 | 10/1949 | Thompson | 100/34 |
| 4,193,340 | 3/1980 | Finn | 100/34 |
| 4,354,787 | 10/1982 | Gensike et al. | 414/54 |

FOREIGN PATENT DOCUMENTS

| | | | |
|---|---|---|---|
| 611219 | 5/1979 | Switzerland | 53/390 |
| 1205 | of 1909 | United Kingdom | 100/34 |
| 464569 | 4/1937 | United Kingdom | 414/54 |
| 1566930 | 5/1980 | United Kingdom | 53/390 |
| 2066219 | 7/1981 | United Kingdom | 211/50 |

*Primary Examiner*—Leslie J. Paperner

*Attorney, Agent, or Firm*—Gottlieb, Rackman & Reisman

[57] ABSTRACT

A receiving cradle for the pre-packaging of items (e.g., stamp booklets) to be oriented in and then dispensed from a criss-cross stack. Initially, pairs of rubber bands are placed on the fixture in a preferred sequence, followed by the loading of alternately stacked booklets forming the criss-cross stack to ultimately be placed into the booklet dispenser equipment. When the prearranged criss-cross stack has been set into place, the operator sequentially draws the rubber bands from their pre-set positions over the opposed corners of the criss-cross stack. The result is an integral stack, rubber banded together, forming a criss-cross booklet package in preassembled form, ready for prompt loading into a dispenser mechanism.

6 Claims, 6 Drawing Figures

BOOKLET CRISS-CROSS STACKING FIXTURE

DESCRIPTION

This invention relates to loading devices in general, and to a cradle fixture which facilitates the orientation of items in a criss-cross stack, in particular.

In modern technology, various items are made available to the consuming public through automatic and semi-automatic vending equipment. Moreover, several industries require that particular articles, generally having a predetermined and constant shape, be placed in precise orientations relative to each other to accommodate packaging, loading or dispensing equipment. This type of arrangement is called for in the food processing and packaging field, and in the dispensing of non-perishable items in the vending equipment field as well.

These criteria often exist because of the corresponding use of equipment which serves to make certain desired items available to consumers on a mass basis, frequently without attended machinery. In such instances, the loading of the dispensing mechanism does become rather important, since the orientation of the article is a prerequisite to the smooth and uninterrupted operation of the dispensing equipment.

In evaluating the reliability of dispensing equipment, one preferred orientation of dispensable items has been recognized, namely a "criss-cross" stack of substantially rectangular articles. These articles are dispensed in an alternating sequence, which is carried out by allowing one or the other of the stack elements to be dispensed, usually by gravity feeding, on a one-at-a-time basis. The perpendicular relationship between alternating elements in the stack permits only one article to drop down at a time, e.g., through a lower bay door or opening; the oppositely oriented item is prevented from dropping through, both by the absence of a proper fit due to the right angle orientation, and because the mechanism is provided with an alternately operable supporting means to selectively block the opening.

Such an arrangement is usual in the dispensing of postage stamp booklets in post offices and in other publicly accessible places. In such situations, coin operated machines are activated by consumers, to obtain a single rectangular booklet of stamps. In those instances, it is important to avoid jamming of the mechanism or multiple dispensings such as "jackpotting", during which the entire load of stored booklets is inadvertently dispensed. The use of criss-cross stacks of booklets helps to insure reliable, one-at-a-time dispensing of such items.

But a basic part of systems of this kind (see, e.g., copending application Ser. No. 668,198, filed contemporaneously herewith), is the recognition that when the equipment becomes exhausted of its stored inventory, as little time as possible should be spent in reloading the machine, so that dispensing can commence anew. Since such equipment incorporates a loading and storage magazine having a cruciform cross-section, an alternating criss-cross stack of booklets must be ready to be loaded into the magazine as promptly as possible. Accordingly, it is desirable to have some booklets prearranged into criss-cross stacks in advance, either by service personnel on site or by technicians at a central service depot. In either event, it is quite useful and helpful to have an arrangement available to assist with and facilitate the loading of booklets into a criss-cross stack configuration. This is far preferable to individual manual loading, which can be done erroneously, which is relatively time consuming and generally cannot be done efficiently in advance.

It is therefore an object of this invention to obviate one or more of the aforesaid difficulties.

It is another object of this invention to provide equipment which facilitates establishing a criss-cross stack of articles to be dispensed.

It is also an object of this invention to orient a stacking fixture to require items placed therein to be stackable and unloaded only in a preferred orientation for subsequent use elsewhere.

GENERAL DESCRIPTION

These and other objects and advantages of this invention will become more readily apparent in connection with describing an embodiment of this invention in which a slanted, offset cradle, accommodating each of the orthogonal orientations of the criss-cross stack, is provided. The cradle has its base at an acute angle to the horizontal, with support posts which receive the stack elements being perpendicular to the angled plane surface of the fixture. This results in the support posts being angled upward at a more vertical but still acute angle, so that the stacked elements may slide into place against the posts when they are placed onto the upper planar surface of the fixture.

The fixture is provided with a number of projecting flanges and tabs to receive therearound rubber bands or other suitably elasticized members which are placed into a substantially triangular configuration prior to the loading onto the fixture of specific booklets. Among the significant structural elements on the fixture are a forward projecting flange lip around the corners of which the two rubber bands utilized in this invention are held. On each of the forward corner edges of the unit are downwardly projecting bosses which act as further corners for receiving each rubber band in its normal or stationary loading position.

The third corner of the triangular rubber band configuration is around the rear of each of the side vertical support posts which receive the ends of the alternate laterally stacked booklets. When a first rubber band is placed into the indicated position, it is established with one major side of the triangle acting as a diagonal across the main upper planar surface of the fixture; the second rubber band, oriented around comparable flanged corner points, crosses the first one in the diagonal position, establishing a virtually perpendicular crossing point at the middle of the upper surface of the fixture. With the rubber bands thusly in place, an underlying receiving configuration is established whereby the booklets are in condition to be loaded.

The booklets are received in two positions, corresponding to each of the orientations of the criss-cross stack. The first orientation is laterally across the width of the stacking fixture, being held in the receiving corners of the two side vertical posts. The other position, perpendicular to the first one, has only one holding receptacle, namely a rear cradling surface which receives the rear end of the longitudinally oriented booklets which are perpendicular to the lateral ones. (There is no need for a fourth holding post, since the slanted orientation of the fixture's upper surface insures that the booklets, including the longitudinally oriented ones in particular, will rest comfortably and definitively in their corresponding receiving post on the fixture's upper surface.)

As the booklets are loaded into place on the top of the fixture's slanted surface, in alternating orientations as has been discussed, an appropriate stack is eventually built up. In order to unload the stack, the rubber bands serve the purpose of stabilizing and retaining the stack for transfer to the ultimate dispensing machine or other use. In order to accomplish this stabilizing effect, the rubber bands are to be drawn away in a particular sequence from the flanged tabs and corner edges previously mentioned, so that they will ultimately occupy retention positions around opposite corners of a cruciform stack. To achieve this, one rubber band is initially removed from two of the forward corner supporting surfaces, with the third corner, at the rear of the side supporting post, remaining stationary throughout the removal process. In so doing, the rubber band is pulled forward and then allowed to move upward so that it ultimately occupies a diagonal position between opposite corners of the criss-cross stack of booklets. When later released, the contraction of the rubber band causes it to assume a reasonably snug retaining position across the interior corners of the stack. Then, the same general procedure is followed for the other rubber band, presumably still in place on the fixture. It, too, is withdrawn from its forward corner holding positions and moved upward on the opposite side of the stack until it occupies the other two corners on the interior edges of the criss-cross stack. During this second procedure, the rear corner of that rubber band is maintained at the rear of the other upstanding corner post, which remains there throughout the process. Ultimately, the second rubber band assumes its diagonal position across the other two corners of the stack and upon release, contracts to provide a snug double-banded holding position for the stack.

Thereafter, the stack is relatively firmly contiguous and can be moved easily as a unit from the loading position, which may be remote from the dispensing location, to an intermediate storage position, or to the appropriate storage location where additional booklets are needed.

It is therefore a feature of an embodiment of this invention that a stacking cradle includes storage positions for the perpendicular loading of alternately inserted booklets to establish a criss-cross stack thereon.

It is another feature of an embodiment of this invention that a fixture is provided with a slanted base surface to insure the proper disposition of the center of gravity of a criss-cross stack built up on the fixture.

It is a still further feature of an embodiment of this invention that a fixture for use in creating a criss-cross orientation for a stack of loaded booklets includes selected support posts and flanged edges to define holding points for rubber bands or the like which are to be detached in order to stabilize the stack when it is ready for unloading and transfer to subsequent dispensing use.

Additional objects, features and advantages of this invention will become more readily understood when considered in conjunction with a presently preferred, but nonetheless illustrative, embodiment of the invention that is explained in the following detailed description and as shown in the accompanying drawing, wherein.

Figure 5:
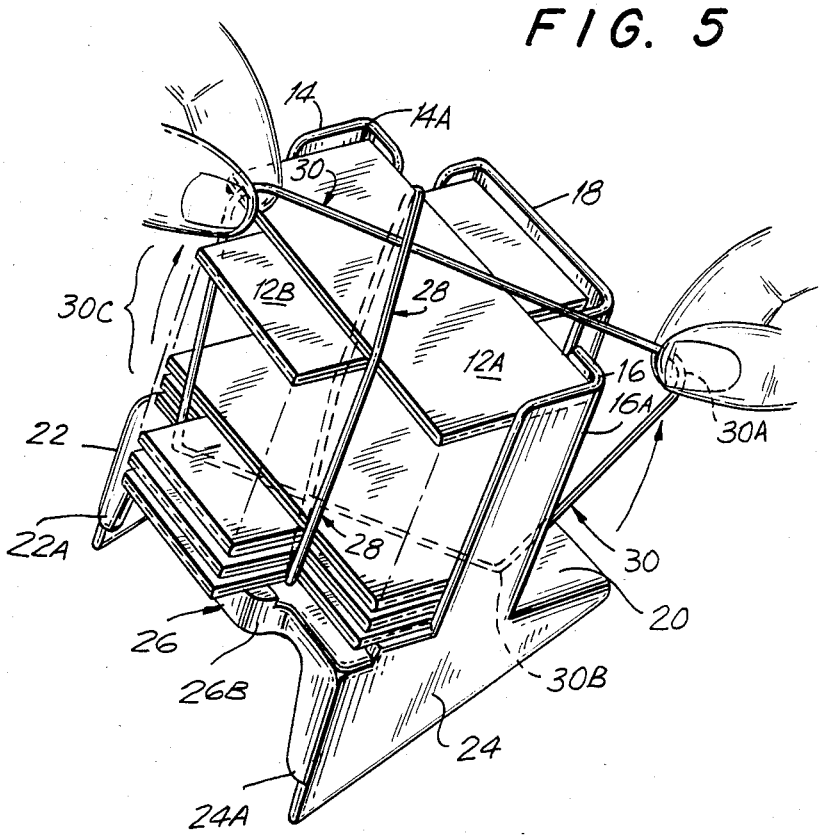
Figure 6:
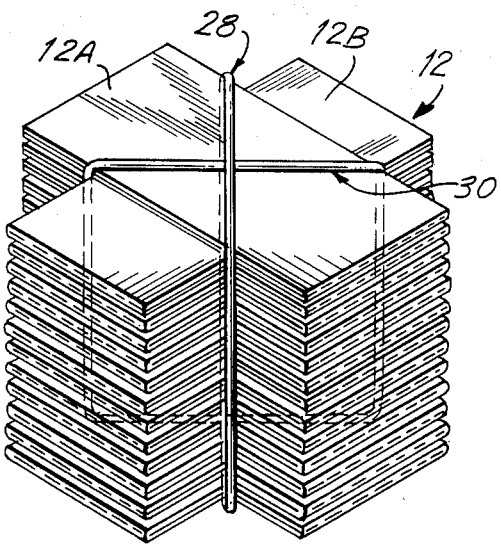

FIG. 5 is another perspective view of the fixture of this invention shown loaded with a complete stack of criss-cross booklets, and indicating one of the two rubber bands already in its stabilizing position and the other being drawn upwards from the lower portion of the fixture and into its corresponding stabilizing position; and FIG. 6 is a perspective view of the completed stack of booklets indicating the final retaining and stabilizing positions of the two diagonally placed rubber bands.

DETAILED DESCRIPTION

In considering the main perspective view of FIG. 1, the invention is contained in fixture 10, which is basically a prearranged receptacle for the deposit therein of a criss-cross stack 12 made up of perpendicular booklets 12A and 12B—throughout this description, the booklets oriented as is booklet 12A will be described as the "lateral" group of booklets, while those oriented as is booklet 12B will be considered the "longitudinal" group of booklets.

The booklets in the stack 12 are adapted to be deposited on the upper surface of fixture 10 and to be held by means of opposite retaining posts 14 and 16, each of which has a right angle configuration establishing respective corners 14A and 16A to receive the rear corner edges of each of the lateral group of booklets such as 12A. Similarly, the longitudinal group of booklets such as 12B is retained in place on the slanted upper surface of fixture 10 by having its rear edge received within the main body of retaining post 18, defined between corresponding corners 18A and 18B; no other post is needed for the longitudinal group of booklets since the slanted surface of fixture 10 insures that those booklets will rest comfortably against the main portion of post 18 without any capability of sliding upward and away therefrom—the center of gravity mandated by the geometry of fixture 10 insures this placement and stability of the booklets.

The upper slanted surface of fixture 10 is defined by reference numeral 20 and receives thereacross triangulated rubber bands 28 and 30 to be described below. The fixture 10 is supported in its slanted orientation by side support legs 22 and 24, each of which has a corresponding forwardly projecting flanged region 22A and 24A respectively. Intermediate the flanged portions 22A and 24A is a forward projecting lip or flange 26 which is shaped to have side projecting corner tabs 26A and 26B, between which is a passageway area 26C to accommodate the departure points for the rubber bands as they proceed towards their lower flanged positions at 22A and 24A.

PLACEMENT OF THE RUBBER BANDS

Figure 1:
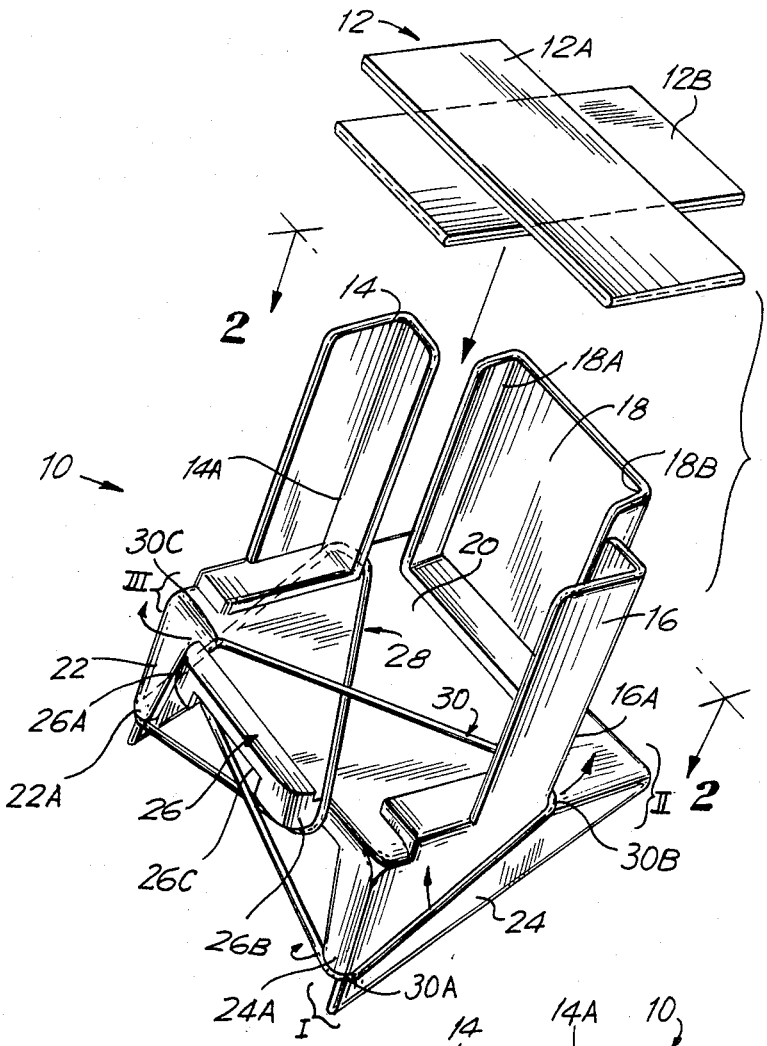
FIG. 1 is a perspective view of the fixture of this invention with rubber bands mounted thereon and indicating, in elevated position, how an illustrative two element stack is loaded into the fixture.
Figure 2:
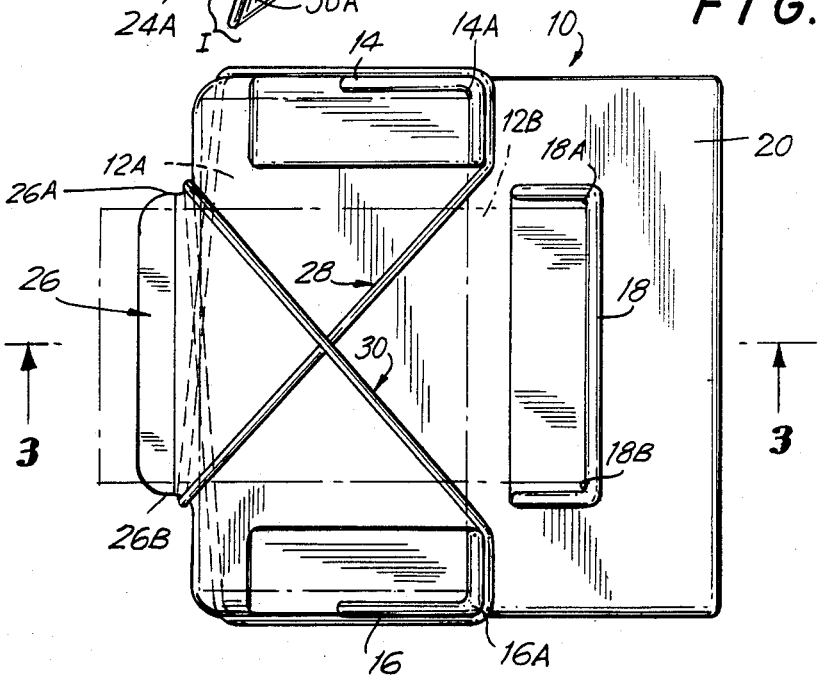
FIG. 2 is a top plan view of the fixture taken along the plane defined by the line 2—2 of FIG. 1 in the direction of the arrows.

Considering FIG. 2 along with FIG. 1, it will be appreciated that each of rubber bands 28 and 30 occupies a triangular geometrical posture with respect to the various holding points on fixture 10. Referring first to rubber band 28, its three points of contact and holding in the loading position illustrated in FIGS. 1–4 include forward points 22A and 26B, and at the rear of left supporting post 14, it is held around corner 14A. (It can be seen from the top view of FIG. 2 that the geometrical shape followed by rubber band 28 in it rest position is not precisely triangular, in view of the passage around post 14, but for all practical purposes and for ease of description, the triangular shape can be considered reasonably accurate.) In a similar fashion, rubber band 30 also has three basic holding points, at left end point 26A of flange 26, at the right lower flange leg 24A and around the rear corner 16A of post 16. In such a manner, rubber band 30 also occupies a diagonal position (beneath rubber 28A) across surface 20, and with both of the crossed rubber bands as seen in FIG. 2, beneath the ultimately loaded-on stack 12 of lateral booklets 12A and longitudinal booklets 12B. (It will be appreciated that whichever of rubber bands 28, 30 is above the other in the configuration shown in FIGS. 1 and 2 is the one to be elevated first, as previously alluded to.)

Figure 4:
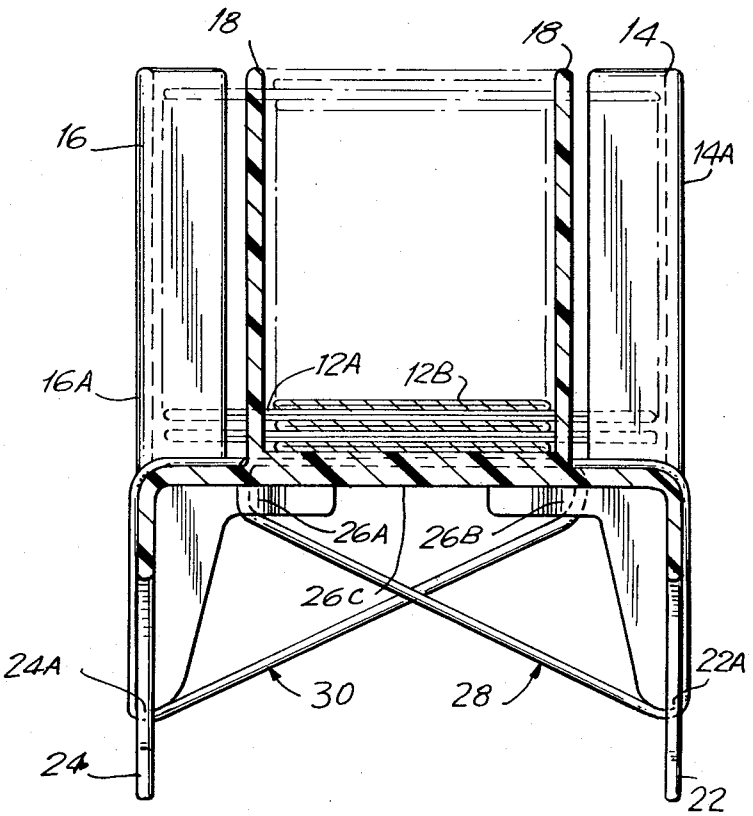
FIG. 4 is a rear cross-sectional view of the fixture, indicating the relative positions of the criss-cross stacking elements and the underlying configuration of the two rubber bands as they occupy their holding positions around the respective tabs and flanges, all taken along the line 4—4 of FIG. 3 in the direction of the arrows.
Figure 3:
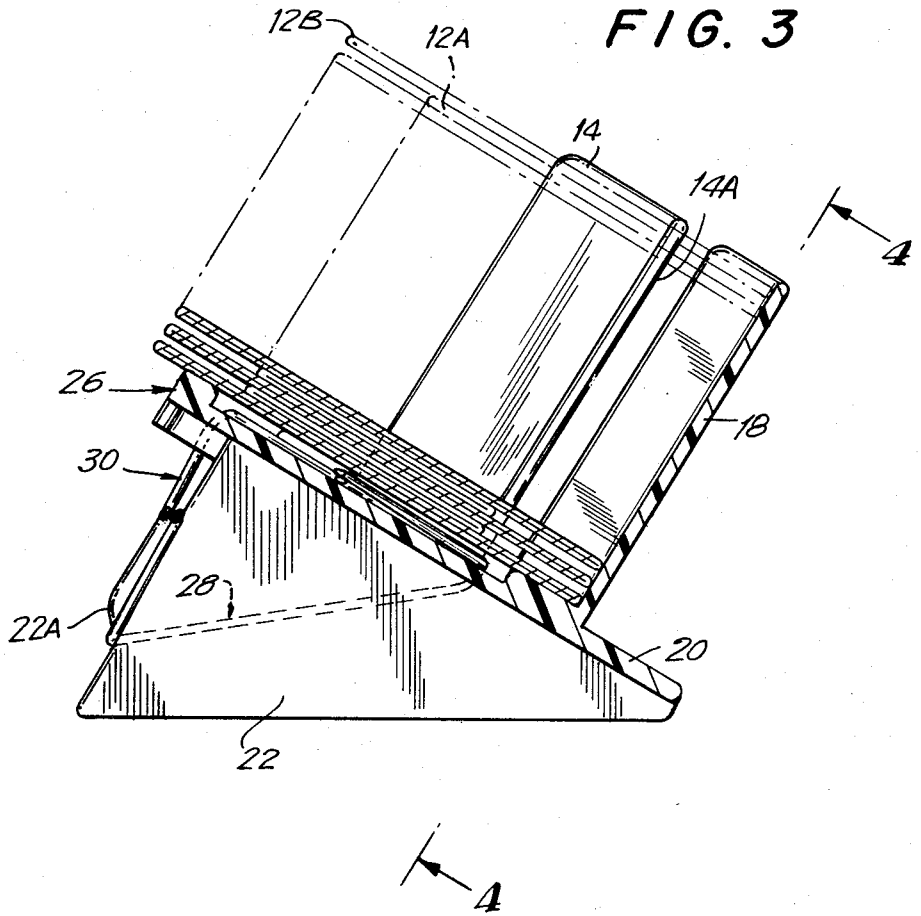
FIG. 3 is a side cross-sectional view through the fixture, indicating the loading therein of a stack of booklets in criss-cross configuration, and taken along the plane defined by the line 3—3 of FIG. 2 in the direction of the arrows.

As can be seen from the views of FIGS. 3 and 4, when a full complement of booklets 12A and 12B is loaded into the fixture, it will occupy a slanted position, seen in FIG. 3, with the longitudinal booklets 12B resting against the rear wall of post 18, and with the rear side edges of booklets 12A resting against each of the left and right lateral portions of posts 14 and 16. Rubber bands 28 and 30 cross beneath the lowermost booklet in the stack as seen in FIG. 3, and also cross under the entire fixture to complete the retention pattern, as seen at the lower part of FIG. 4.

REMOVAL OF THE RUBBER BANDS

The views of FIGS. 5 and 6 demonstrate the manner in which rubber bands 28 and 30 are initially removed from their resting positions on the front and upper surface of fixture 10, and are repositioned to occupy the diagonal retaining configuration shown completed in FIG. 6 and partially completed (and in progress) in FIG. 5. Considering FIG. 1 as well, and dealing with rubber band 30 which is shown being moved into final position in FIG. 5, and also bearing in mind that this procedure can readily be accomplished using only one operative hand (e.g., the hand shown holding a rubber band segment at 30A in FIG. 5), the operator grasps the corner of rubber band 30 at the indicated position I, corresponding to segment 30A of rubber band 30. That segment is withdrawn somewhat to the left in FIG. 1, as indicated by the curved directional arrows at areas I and III. Thus, segment 30A is removed from its position held by corner flange 24A and is moved forward and upward as indicated by its corresponding directional arrow; by this same general action, segment 30C is withdrawn forward and thereby removed from corner 26A of lip 26 and it, too, follows the path generally indicated by the directional arrow at area III.

The overall segment of rubber band 30 which extends from portion 30A to portion 30C is then moved out and up, virtually as a unit, following the curved directional arrows in FIG. 1, so that it is elevated slightly above the top of booklet stack 12. The rubber band is now in position to be placed over the top of the stack as will be described below. During this procedure, segment 30B of rubber band 30, located at rear region II, initially stays in a stationary position, thereby continuing the generally triangular configuration of rubber band 30. Eventually, as the segment of rubber band 30 between portions 30A and 30B is moved upwardly, as indicated by its corresponding directional arrow in FIG. 1, rubber band 30 will ultimately be positioned in the space between posts 16 and 18, as best indicated by the top view of FIG. 2.

Reverting to the view of FIG. 5, the position of rubber band 30 has now changed to that where it is being placed into final position for retention of the stack of booklets. It will initially be noted from FIG. 1 that the main holding point of rubber band 30, namely segment 30B around corner 16A of post 16, is essentially in the same position as before. However, the user is shown holding segment 30A of the rubber band, previously held down at corner flange 24A in the lower right at area I of the rubber band, which has now been moved by the operator's right hand to a position almost directly above part 30B of the rubber band 30. At the same time, following the step indicated at area III in FIG. 1, the rubber band at 30C has been elevated to the opposite diagonal corner and, after some resilient stretching, is prepared to traverse the vertical height of the stack in the opposite corner thereof from that previously described with respect to portion 30A. During this time the segment of rubber band 30 at corner edge 16A, designated as area II, remains essentially in the same position.

Shortly after the view illustrated in FIG. 5, the operator releases right portion 30A and allows rubber band 30 to contract around the opposite diagonal corners of the stack. This permits the rubber band to assume the contracting and retaining position at 30 as shown in FIG. 6, with the entire stack 12 of booklets 12A and 12B being retained in reasonably snug but not rigid positions relative to each other, and yet being capable of transfer and shipment to a loading magazine or other storage arrangement as dictated by the needs of the equipment. Included within this type of structure is that of copending application Ser. No. 668,198, filed contemporaneously herewith and assigned to the assignee of the present application.

In a similar fashion to that previously described, rubber band 28 is also elevated by the operator's hand from the initial position illustrated in FIGS. 1 and 2 to the final holding position illustrated in FIG. 6, passing the stage illustrated in FIG. 5. For example, the operator's left hand may be utilized to grasp the corner of rubber band 28 which passes beneath flange 22A and by withdrawing the segment to the left in FIG. 2, rubber band 28 will also be removed by that action from corner 26B of lip 26. This segment of rubber band 28 is then integrally moved so that it emerges at the top of booklet stack 12. While this movement is occurring, the portion of rubber band 28 which passes around the bottom of corner 14A of post 14 remains generally in that same position, ultimately arriving at its final orientation between posts 14 and 18 (e.g., see FIG. 2), as best represented by the view of FIG. 5.

Rubber band 28 has accordingly moved from its initial rest position and now occupies holding configuration shown in FIG. 5. The rubber band 28, together with rubber band 30, retains stack 12 across diagonally opposite corners thereof, and this has been accomplished for rubber band 28 generally in the same fashion as has already been described with respect to rubber band 30. Thereafter, stack 12 is removed to the separate position illustrated in FIG. 6 and is ready to be placed into an appropriate loading magazine as previously mentioned.

The sequence of withdrawing the rubber bands from the positions illustrated in FIG. 1 to those shown in FIG. 5 is dependent only on the original overlapping relationship of those rubber bands, and since the fixture may be retained in a stationary and fixed position on a work surface, the previously described withdrawal of rubber bands 28 and 30 from their initial positions and the application thereof to respective holding positions around stack 12 can be accomplished by the operator's using one hand at a time with respect to each rubber band.

It will therefore be appreciated that a unique slanted stacking fixture has been created which is adapted to facilitate the mounting and loading thereon of criss-cross booklets, with rubber bands occupying an initial loading position to allow for uninterrupted insertion of booklets in lateral and longitudinal perpendicular configurations. The configurations are enchanced and maintained by the slanted upper surface of the fixture, which virtually compels the booklets to be retained in the appropriate positions once they have been loaded in directly. Thereafter, the rubber bands are removed from their underlying storage positions and sequentially positioned upward and over the top of the interleaved booklets in such a manner as to occupy diagonal interior corners of the stack. When the rubber bands are released, they retain the booklets firmly in place and allow for appropriate loading and transit elsewhere.

It is to be understood that the above described embodiments are merely illustrative of the application of the principles of this invention. Numerous variations may be devised by those skilled in the art without departing from the spirit or scope of the invention.

We claim:

1. A fixture for facilitating the development of a criss-cross stack of interleaved articles of a predetermined configuration, comprising:

a cradle having a planar upper surface oriented at an acute angle to the horizontal and a forward supporting wall between said planar upper surface and the horizontal, a pair of opposed side posts substantially perpendicular to said upper surface for supporting one group of said articles oriented in a first direction, a rear wall member for supporting a second group of said articles oriented in a second direction, said articles comprising substantially rectangular members corresponding to said predetermined configuration and having opposite side and end edges, each of said members having a longitudinal axis parallel to said side edges, said first direction of said one group of said articles comprising even alternate ones of said members having said longitudinal axis thereof aligned, said second direction of said second group of said articles comprising odd alternate ones of said members having said longitudinal axis thereof aligned and also perpendicular to said longitudinal axis of said even alternate ones of said members, each of said pair of opposed side posts comprising a side wall portion and a back wall portion substantially perpendicular to said side wall portion, thereby defining a corner edge portion therebetween, said side wall portions being spaced apart to accommodate said end edges of said odd alternate ones of said members therebetween along said corresponding longitudinal axis thereof, and said rear wall portions being aligned with each other to define a discontinuous supporting surface for one of said side edges of said members, projecting means on said forward wall defining multiple holding positions thereon, said projecting means comprising a flange portion attached to said forward supporting wall, said flange portion having a first corner edge and an opposite second corner edge, said forward wall having first and second corner legs extending between said planar upper surface and said horizontal and thereby defining said acute angle, and retaining means initially occupying inactive positions on said upper surface and around said projecting means during the loading into said cradle of said articles, and for subsequently occupying stabilizing positions around said stack during removal of said articles from said cradle, each of said forward wall corner legs including a discontinuous surface to define a corner receiving area for said retaining means.

2. A fixture in accordance with claim 1 wherein said discontinuous surface on each of said legs comprises a gripping surface, and wherein said retaining means comprises at least one resilient member initially mounted in a predetermined geometric configuration on said fixture and adapted for removal therefrom and for corresponding attachment around said stack.

3. A fixture in accordance with claim 2 wherein said retaining means includes a pair of said resilient means.

4. A fixture in accordance with claim 3 wherein a first one of said resilient means is normally inactively disposed in a first substantially triangular configuration on said fixture defined by a first of said gripping surfaces of said first corner leg, by said second corner edge of said flange, and by said corner edge portion of one of said side posts, and wherein a second of said resilient means is normally inactively disposed in a second substantially triangular configuration on said fixture defined by a second of said gripping surfaces of said second corner leg, by said first corner edge of said flange and by said corner edge portion of the other of said side posts, and said first and said second resilient means are adapted to be transferred from said normally inactive positions to active positions for retaining said stack prior to said removal of said articles from said cradle.

5. A fixture in accordance with claim 4 wherein said first one of said resilient means is transferred from said normally inactive position to said active position by removing said first resilient means from said first gripping surface and from said second corner edge, a lower segment of said first resilient means between said second corner edge and said corner edge portion of said one of said side posts remaining substantially in the same orientation and position during such transfer, and said second one of said resilient means is transferred from said normally inactive position to said active position by removing said second resilient means from said second gripping surface and from said first corner edge, and the lower segment of said second resilient means between said first corner edge and said corner edge portion of the other of said side posts remaining substantially in the same orientation and position during such transfer.

6. A fixture in accordance with claim 5 wherein said rectangular members of said stack comprise a cruciform arrangement, with four interior corners, each corner disposed at the intersection of said side edges of said even and odd alternate ones of said members, said cruciform arrangement further including a predetermined height of said stack of said members, defining a substantially flat top surface thereof and wherein said active position of said first and second resilient means includes each of said respective lower segments thereof, and extended portions of each of said resilient means surrounding said stack and disposed in each of said interior corners and extending therealong for said predetermined height, and further including a connecting element bridging diagonally opposite ones of said corners across said top surface of said stack, each of said resilient means in said substantially triangular configuration in said inactive position corresponding to a continuous length comprising said lower segment, said extended portion and said connecting element of the respective ones of said resilient means in said active positions.

* * * * *